US005079812A

United States Patent [19]

Sasaki et al.

[11] Patent Number: 5,079,812

[45] Date of Patent: Jan. 14, 1992

[54] TOW FEEDING APPARATUS

[75] Inventors: Katsutoshi Sasaki, Shiga; Kenji Hamada, Moriyama, both of Japan

[73] Assignee: Chisso Corporation, Ohsaka, Japan

[21] Appl. No.: 594,932

[22] Filed: Oct. 10, 1990

[30] Foreign Application Priority Data

Oct. 12, 1989 [JP] Japan ..... 1-265714
Dec. 27, 1989 [JP] Japan ..... 1-338933

[51] Int. Cl.[5] ..... B65H 63/00
[52] U.S. Cl. ..... 28/223; 226/91
[58] Field of Search ..... 19/52; 28/185, 223, 28/282; 226/91; 242/18 A, 18 PW, 25 A

[56] References Cited

U.S. PATENT DOCUMENTS 4,185,761 1/1980 Miyazaki et al. ..... 242/18 R X
4,454,996 6/1984 Windeler et al. ..... 242/18 PW X
4,557,423 12/1985 Zingler ..... 242/25 A X

*Primary Examiner*—Werner H. Schroeder
*Assistant Examiner*—John J. Calvert
*Attorney, Agent, or Firm*—Fay, Sharpe, Beall, Fagan, Minnich & McKee

[57] ABSTRACT

A tow feeding apparatus which requires no continuous observation, shortens the reset time when tow is wound around pinch rolls for feeding into a case, and operates safely, includes guide rolls for leading a tow to a winding roll or pinch rolls, a winding roll apparatus provided between the guide rolls and pinch rolls at a normal position for winding up a tow around a winding roll when wrapping trouble occurs at the pinch rolls. A pinch roll apparatus for feeding the tow from the guide rolls through the winding roll apparatus into a case, and a transport device for transporting the winding roll apparatus from the normal position to a reset position behind the pinch roll apparatus when wrapping trouble occurs. A cutter shears the tow along the tow route before the pinch roll apparatus. An exchanger for substituting the pinch roll apparatus with another set of pinch rolls, and a detector for detecting wrapping of a tow around the pinch rolls are further included. A controller receives a signal from said detector to actuate the cutter and the driving motor for driving the winding roll, stops the pinch roll apparatus, drives the exchanger, actuates the transport device for moving the winding roll apparatus from the normal position to the reset position, starts the pinch roll apparatus at the same time as the winding roll apparatus is stopped, and returns the winding roll to the normal position.

13 Claims, 4 Drawing Sheets

TOW FEEDING APPARATUS

BACKGROUND OF THE INVENTION

1. Field of the Invention

This invention relates to a tow feeding apparatus. More particularly, it relates to a tow feeding apparatus wherein continuous watching of the tow fed into a case through pinch rolls is made unnecessary, a resetting time of the tow is shortened when the tow winds around the pinch roll, and a safe operation is assured.

2. Description of the Related Art

Melt-spinning of general-purpose synthetic fibers such as those of polyesters, polypropylene, etc. has generally been carried out by extruding a molten polymer through a number of spinning nozzles to obtain a number of filaments, and collecting the filaments in a form of a tow which is then stored in a case.

FIG. 2 shows a schematic view illustrating a conventional apparatus for feeding a tow into a case. In the figure, a number of filaments 2 extended from spinning nozzles 1 are cooled, drawn by a take-up roll 3 and collected to form a tow 4. The tow 4 is then fed into a case 12 via guide rolls 5 by means of pinch rolls, that is a pair of rolls 8 and 9 rotating at a high speed.

The total denier of tow is generally as large as several thousand to several hundred thousand deniers in order to raise productivity. The feeding conditions of pinch rolls 8, 9 have been carefully set by choosing the nip pressure thereof and the speed ratio thereof relative to guide rolls 5 or by choosing spinning oils, etc. However, due to single filament breaks or wrapping of single filaments n the tow around the rolls, wrapping of a tow around the pinch rolls often occurs during operation.

Once wrapping around the pinch rolls 8, 9 has occurred, the pinch rolls 8, 9 are stopped in operation, and then a tow is wound around a winding roll 6 via a tow-passing route E by hand or by an air sucker, followed by removing tow wastes wrapped on the pinch rolls, changing a tow-passing route to a route F by hand, and again starting the pinch rolls as well as stopping the winding roll 6.

According to the conventional apparatus, once wrapping on the pinch rolls 8, 9 has occurred, the pinch rolls have to be stopped in operation and the wrapped tow wastes removed. Further, when the pinch rolls 8, 9 are stopped late, the tow stored in the case may also have become wrapped on the pinch rolls. When wrappings of tow on all rotating bodies occur, all rotating parts such as takeup rolls 3 and guide rolls 5 have to be stopped. For returning such a state to a normal one, it has been necessary to remove the wrapped wastes from the rotating parts. Further, when the time for resetting a tow is prolonged, the extrusion of a molten polymer has to be stopped. Thus, until the resetting has been attained, a rather long time has been required, resulting in the waste of a large quantity of tow. Further, since an extraordinary load has been applied to the gears in the gear box of the pinch rolls due to the wrapped tow, the gears have often been broken. Thus, continuous watching has been required for minimizing the wrapping around the pinch rolls, and much labor has been required for the reset operations, which may be dangerous.

SUMMARY OF THE INVENTION

The object of the present invention is to provide a tow feeding apparatus with means for rapidly removing a tow wrapped around pinch rolls, and rapidly resetting a tow with high safety.

The present invention has the following main constitution:

a tow feeding apparatus having pinch rolls for feeding a tow into a case, which comprises guide rolls for leading a tow to a winding roll or pinch rolls;

a winding roll apparatus which is provided between said guide rolls and pinch rolls, that is at a normal position, for winding up a tow around a winding roll at the time of wrapping trouble of said pinch rolls, comprising a winding roll and a driving motor for driving said winding roll;

a pinch rolls apparatus for feeding said tow from the guide rolls through said winding roll apparatus into a case;

a transporting means for said winding roll apparatus to go over said pinch rolls apparatus from said normal position to a reset position behind the pinch rolls apparatus at the time of wrapping trouble;

a cutter for shearing the tow provided at the tow route before said pinch rolls apparatus;

an exchanger of said pinch rolls apparatus for another one;

a detector for detecting the wrapping of a tow around the pinch rolls; and control means for receiving a signal from said detector, actuating said cutter, actuating said driving motor for driving the winding roll, stopping the pinch rolls apparatus, driving said exchanger for exchanging the pinch rolls apparatus for another one, actuating said transporting means for moving the winding roll apparatus from said normal position to the reset position, starting the pinch rolls apparatus at the same time as the winding roll apparatus is stopped, and returning the winding roll to said normal position.

DETAILED DESCRIPTION OF PREFERRED EMBODIMENTS

The present invention will be described in more detail referring to the accompanying drawings.

Figure 1:
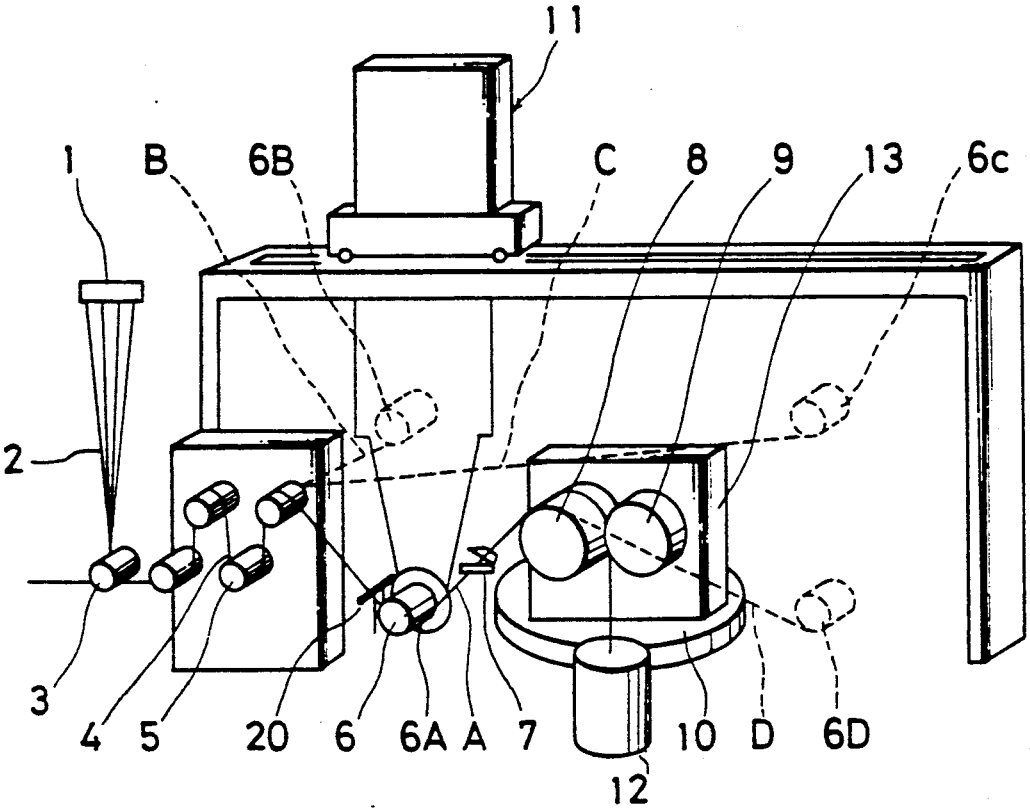
FIG. 1 shows a schematic view illustrating the whole of an apparatus of the present invention.
Figure 2:
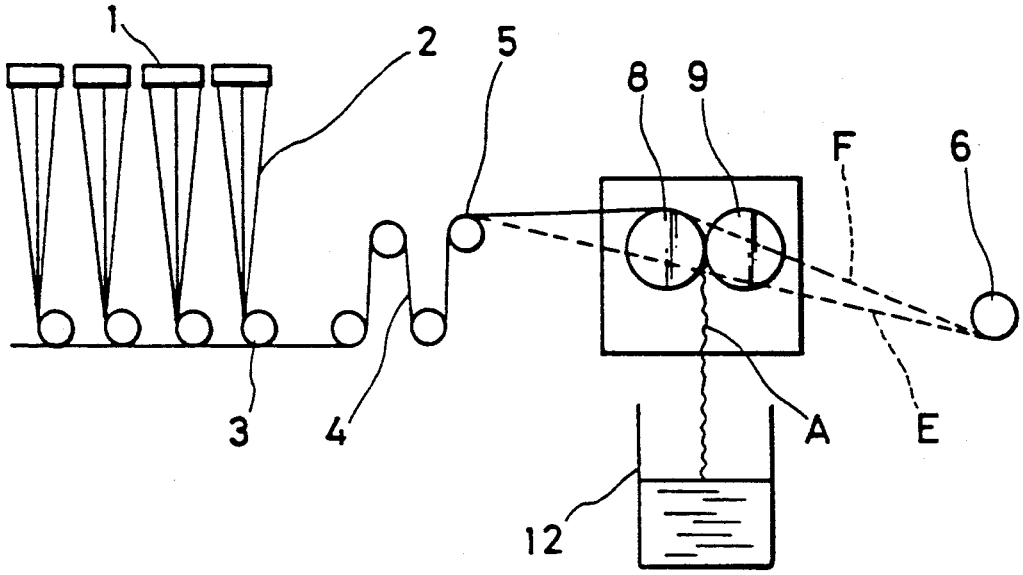
FIG. 2 shows a schematic front view illustrating a conventional apparatus.

As shown in FIG. 1, the apparatus of the present invention comprises the following components:

guide rolls 5 for leading a tow 4 to a winding roll or pinch rolls 8, 9;

a winding roll apparatus 25 which is provided between said guide rolls 5 and pinch rolls 8, 9, that is at a normal position 6A, for winding up a tow around a winding roll 6, comprising a winding roll 6, a driving motor 21 for driving said winding roll 6, and a pusher 22 optionally provided for moving said winding roll 6 in the axial direction thereof by a predetermined length;

a pinch roll apparatus located at a pinch roll station for feeding said tow from the guide rolls 5 through said winding roll apparatus 25 into a case 12;

a transporting means 11 for said winding roll apparatus 25 to go over said pinch roll apparatus from said normal position 6A to a reset position 6D behind the pinch roll apparatus at the time of wrapping trouble;

a cutter 7 for shearing the tow provided at the tow route before said pinch roll apparatus;

an exchanger 54 (shown in FIGS. 3 and 4) of said pinch roll apparatus for another one;

a detector 16 (shown in FIGS. 3 and 4) for detecting wrapping of a tow around the pinch rolls 8, 9; and control means (not explicitly shown) for receiving a signal from said detector 16, actuating said cutter 7, actuating said driving motor 21 for driving the winding roll 16 (and the pusher 22), stopping the pinch roll apparatus, driving said exchanger for exchanging the pinch roll apparatus for another one, actuating said transporting means 11 for moving the winding roll apparatus from said normal position 6A to the reset position 6D, starting the pinch roll apparatus at the same time as stopping the winding roll apparatus 25, and returning the winding roll 6 (with the pusher 22) to said normal position 6A.

A series of guide rolls 5 are provided for leading the tow 4 from spinning nozzles 1 to the winding roll 6, and further to the pinch rolls 8, 9.

Figure 4:
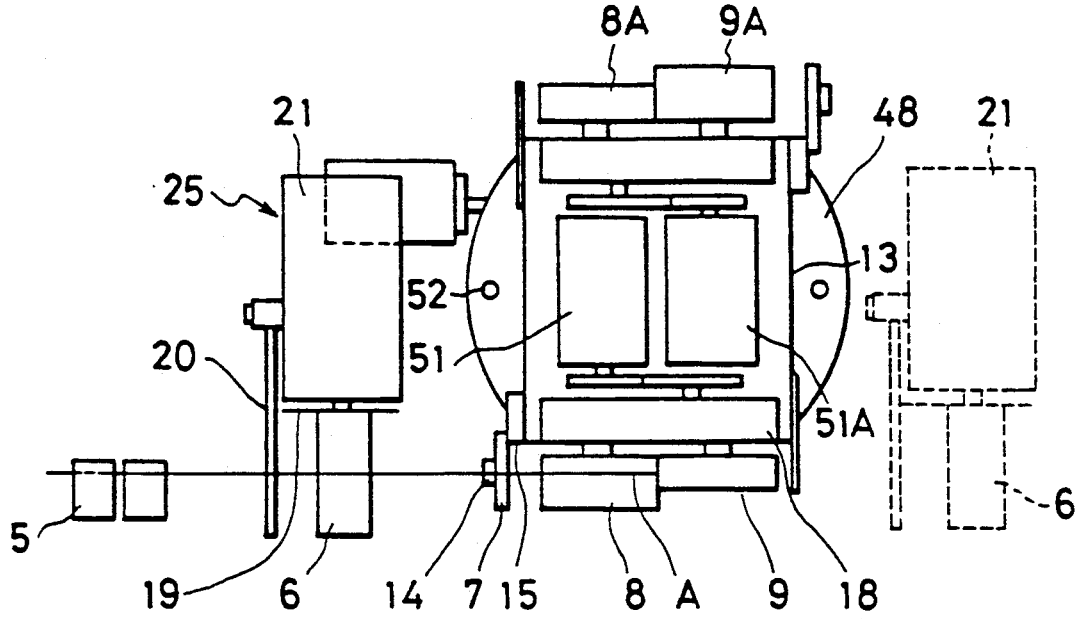
FIG. 4 shows a schematic plan view taken along lines 4—4 of FIG. 3.

A tow guide 20 is preferably provided at the inlet side of the winding roll 6. This guide 20 has a pair of guide bars 70 (see FIG. 5) as a traverse means for traversing the tow within the width of the winding roll 6 in order to wind up a tow uniformly on the roll. In FIG. 4, the tow guide 20 is shown to be fixed to the winding roll apparatus 25 via a traverse motor 71.

Figure 8:
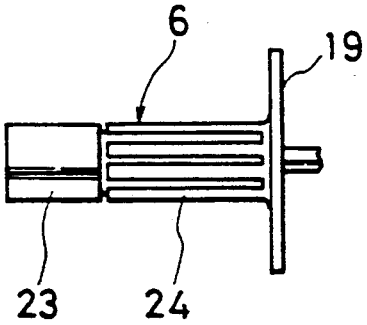
FIG. 8 shows a schematic view illustrating one embodiment of a winding roll used in the present invention.

The winding roll 6 of the present invention may have a smooth plain surface without any projection and depression (see FIGS. 4 and 5) or have a surface consisting of two different surface sections as shown in FIG. 8, one of them having a smooth surface section 23 substantially without any projection and depression and the other having a fluted surface section 24 as a rough surface section. The smooth surface section 23 is positioned so as to include the end part of the winding roll 6, while the fluted surface section 24 is oppositely positioned as shown in FIG. 8. The smooth surface section 23 preferably has electroplated chrome finish or an electroplated satin finish. The tow is wound around the fluted surface section 24 of the roll when the winding roll 6 is pushed by a predetermined length, and the tow is passed through the smooth surface section 23 to the pinch roll apparatus when the winding roll 6 is returned to the original position. The winding roll 6 also may have a collar 19 (FIG. 8) for inhibiting a tow from winding around the shaft of a motor 21.

Figure 5:
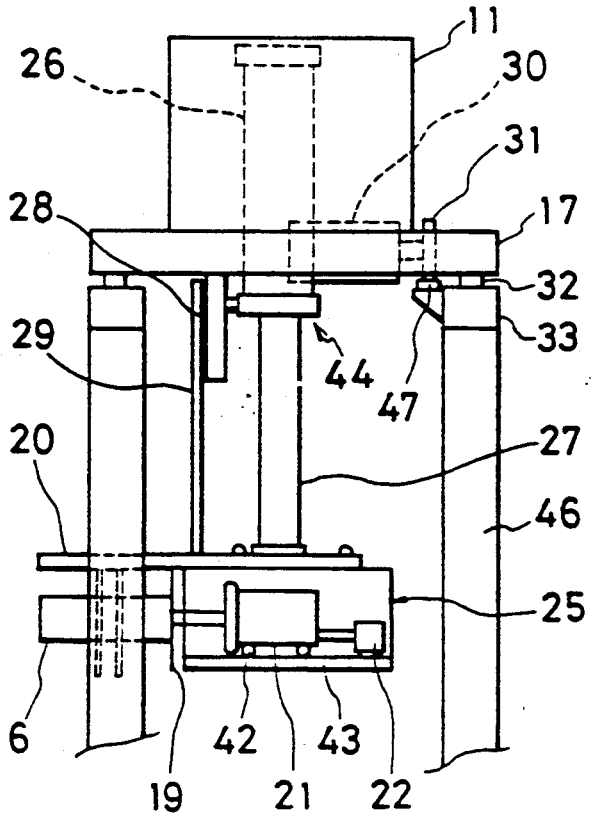
FIG. 5 shows a fragmentary side view taken along lines 5—5 of FIG. 3.

Referring to FIG. 5, the winding roll apparatus 25 consists of a winding roll 6, a driving motor 21 for driving the winding roll 6 and a pusher 22 for moving the winding roll 6 in the axial direction by a predetermined length. The motor 21 for driving the winding roll 6 is installed on a pedestal 43 by the medium of wheels 42 which is supported on rails provided on the pedestal 43. Further, the rear part of the motor 21 is connected to the pusher 22 consisting of an air cylinder for pushing forward or pulling back the motor 21.

Figure 3:
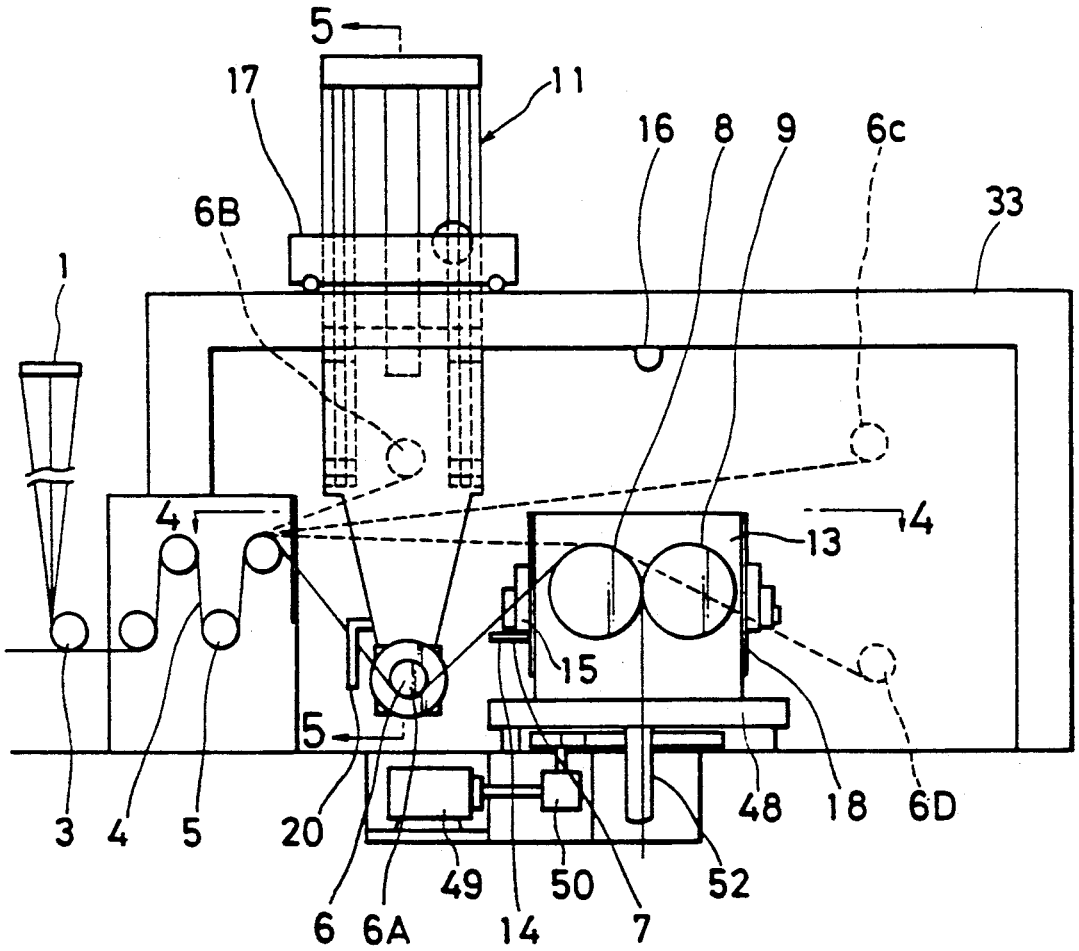
FIG. 3 shows a schematic front view of the whole of an apparatus of the present invention.

The detector 16, shown in FIG. 3, for detecting wrapping of a tow around a pinch roll may be a sensor for detecting yarn wrapping or tow wrapping, a means for detecting an abnormal current value of the driving motor, of the pinch roll apparatus, or a detecting means for detecting image information from an image sensor at the time of the above wrapping troubles, and further, both detecting means may be provided.

Figure 7:
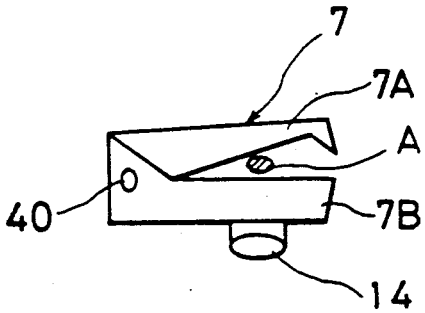
FIG. 7 shows a schematic view illustrating a cutter provided with an air-jet means.

The cutter 7 used in the present invention is automatically actuated by a signal sent from the detector 16 indicating the wrapping trouble of the tow around the pinch rolls 8, 9. The cutter 7 may be fixed onto the tow route so that the blade of the cutter shears the tow at the time of a wrapping trouble, or may be located at the side of the tow route at the time of normal operation and pushed out onto the tow route by means of a cutter-moving means like a pusher 15 (FIG. 3) at the time of a wrapping trouble. In order to help the tow cut by the cutter 7 to wind around a winding roll 6, air-jet means for blowing air toward the cutter may by provided as shown in FIGS. 3 and 7. In FIG. 7, a cutter blade 7A and a support 7B are joined together by means of a hinge joint 40. The support 7B has an air opening 14 that communicates with to the air-jet means. A tow A is passed between the cutter blade 7A and the support 7B, and at the time of cutting, it is sheared by a hinging motion of the cutter blade 7A. The cutter and the air-jet means may be actuated by means of an electromagnetic valve. Further, it is possible to arrange a plurality of cutters 7 corresponding to the number of pinch roll apparatuses. Further, the cutter may be provided on a housing 13 or independently of the housing 13 (FIG. 3).

The transporting means 11 may be any means capable of transporting the winding roll apparatus between the normal position 6A and the reset position 6D. A typical example of the means is shown in FIGS. 3 and 5, and comprises a platform 33 laterally installed over said pinch roll apparatus; a truck 17 provided on said platform 33 by means of wheels 32; an elevator 44 operably associated with said truck 17, for moving said winding roll apparatus upward or downward; and driving means of said truck 17 and said elevator 44 between said normal position 6A and said reset position 6D of the winding roll apparatus.

The elevator 44 for moving the winding roll apparatus 25 upward or downward comprises an air cylinder 26 and a piston 27 incorporated thereinto. The piston 27 is fixed to the winding roll apparatus 25 at the lower end thereof. The air cylinder 26 engages a supporting plate of a truck 17. A guide 28, the upper end of which is fixed to the truck 17, is engaged with a guide rail 29 which is provided vertically and fixed to the winding roll apparatus 25. The guide 28 further operably engages the air cylinder 26.

The guide 28 and the guide rail 29 inhibit the lateral movement or vibration of the winding apparatus 25 when it is moving. The winding roll apparatus 25 can ascend or descend in accordance with the movement of the piston 27 of the air cylinder 26.

The platform 33 is laterally supported on columns 46 over the pinch roll apparatus and in parallel with the tow route (FIG. 5).

A motor 30 as a driving source for traversing the elevator 44 is provided at the elevator 44. A pinion 31 attached to the shaft of the motor 30 is in mesh with a rack 47 fixed to the platform 33 (FIG. 5).

Returning to FIGS. 3 and 4, the pinch rolls apparatus comprises pinch rolls 8 and 9 for feeding a tow into a case 12, a driving motor 51 joined to the shaft of the pinch rolls, a housing 13 of the motor 51, a turntable 48 on which the driving motor 51 is installed, and pins 72 for fixing the turntable. The turntable 48 is rotatable around a shaft 52 by means of a motor 49 through a bevel gear 50. The other set of pinch roll apparatus (pinch rolls 8A, 9A and Motor 51A) is installed on the same turntable so that it is exchangeable with the former by rotating the turntable.

As an exchanging method of the pinch roll apparatus, besides the above method of employing a turntable, a method of running pinch rolls apparatuses on a rail one after another at the time of exchange may be employed. The number of pinch rolls apparatuses is preferred to be larger, but two thereof are usually employed from the point of economy.

Figure 9A:
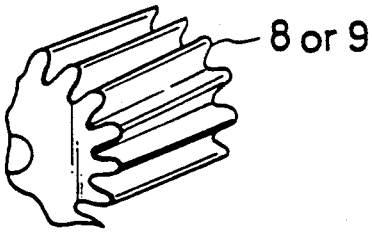
FIG. 9A shows a fragmentary schematic view of a pinch roll of a gear type having a corrugated surface.
Figure 9B:
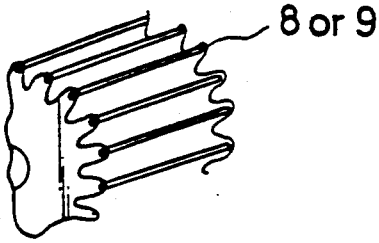
FIG. 9B shows a fragmentary schematic view of a cage-type pinch roll.

Examples of pinch rolls 8 and 9 are those of metal rolls each having a flat surface, those of a gear type (FIG. 9A), those of a cage type having bars bridging the ridges of corrugated side plates (FIG. 9B), and the like. The width of the pinch roll 8 is usually larger than that of the pinch roll 9.

Figure 6:
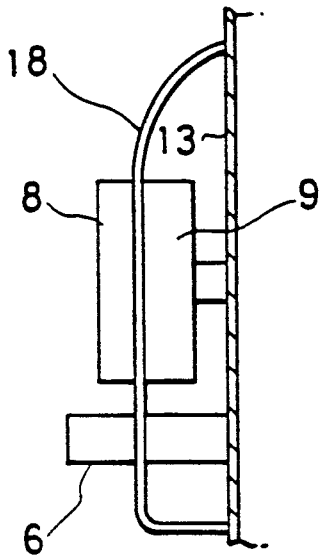
FIG. 6 shows a fragmentary side view illustrating a pinch rolls apparatus provided with a guide bar.

A guide bar 18 is preferably provided on the housing 13 at the forward side of the pinch roll 9 as shown in FIGS. 3, 4 and 6. This guide bar 18 makes it possible to inhibit the tow from wrapping around the shaft of the pinch rolls 8, 9, and guides the tow along an exact tow route via the upper surface of the pinch roll 8, which is wider than the winding roll 6, when the winding roll 6 descends from the position 6C to the position 6D as shown in FIG. 3.

The control means of the present invention includes an actuator of the cutter 7 for shearing the tow in response to a signal from said detector 16 when said wrapping of the tow on the pinch rolls is detected, an actuator of said winding roll apparatus 25 actuated by a signal from the detector 16, and a stopping means for stopping said winding roll apparatus 25 after cutting of the tow. A controller of the exchanger of the pinch roll apparatus functions so that the pinch roll apparatus is exchanged for another one at the same time as the winding roll apparatus 25 is stopped. A controller of said elevator and said driving means of said truck 17, which is actuated after the shearing of the tow and functions so that said winding roll apparatus 25 moves upward from the backward side of the pinch roll apparatus (normal position 6A) moves laterally over said pinch roll apparatus along the tow route, and further moves downward to the forward side of the pinch roll apparatus (reset position 6D). A starting means starts the pinch rolls apparatus when the winding roll apparatus 6 reaches said reset position 6D, and a stopping means stops the winding roll apparatus 25 at the same time. Finally, a controller is also provided for returning the winding roll 6 to position 6A after removal of waste from the winding roll.

Control systems of the respective devices of the present invention may include those for controlling rotating speeds of pinch rolls, a winding roll, guide rolls and the like, and those for positional relationship, actuation order relationship, and a time relationship of the respective devices. Some of the above control systems may be incorporated into sequence process controls or microcomputers.

The air cylinder 26 may be replaced by a hydraulic cylinder and the like.

Next, the function of the present invention will be described referring to the embodiments of FIGS. 3 to 5.

When a tow is normally fed into the pinch rolls 8 and 9, the tow 4 from a take-up roll 3 is introduced into a series of guide rolls 5 and then passed through a smooth surface section 23 of the winding roll 6 rotating at a normal position 6A as a normal roll position. Then the tow is fed to the pinch rolls 8 and 9 through a tow route A and stored in a case 12. Tow guide 20 provided before the winding roll 6 has been stopped and the tow is passed through the middle part of the tow guide (FIG. 1). The rotating speeds of the respective guide rolls 5 are the same as that of the take-up roll 3 or set to slightly higher values in the order of the pinch rolls 8, 9, the winding roll 6 and the guide roll 5.

When the tow has wrapped around the pinch rolls 8, 9 by accident, a signal received from a detector 16 is received by a controller, a cutter-moving means 15 is actuated, and a cutter 7 is pushed forward and enters the tow route A. At the same time, a pusher 22 in the winding roll apparatus 25 (FIG. 5) is actuated and the winding roll 6 is pushed forward so that is changes the tow route from the smooth surface section 23 to the fluted surface section 24 (FIG. 8). At the same time, an electromagnetic valve of an air-jet means is opened to blow air from the opening 14 to the tow. Further, the cutter 7 is actuated by the electro-magnetic valve to shear the tow, and at the same time, tow is wound around the fluted surface section 24 of the winding roll 6. The air-jet means helps the tow to wind around the winding roll 6. Further, a tow guide 20 is actuated and the tow starts to traverse in the width direction of the winding roll 6, whereby the tow is uniformly wound around the winding roll 6. After a certain time lag, the pinch rolls 8, 9 are stopped in rotation, whereby the first stage automatic operation for resetting a tow is finished.

Next, after the tow cutting, right and left pins 12 for fixing the turntable 48 are retracted (FIG. 4). Thereafter, a driving motor 49 for turning the turntable is driven, and the turntable 48 is slowly rotated by an angle of 180° by the medium of gears 50 around the shaft 52 of the turntable (FIG. 3) so that the pinch rolls 8, 9 are exchanged for the others 8A, 9A (FIG. 4). The pins 72 for fixing the turntable 48 are set again and the tow feeding apparatus is in the state of awaiting until the setting of the winding roll apparatus mentioned below is finished.

The winding roll 6 having a tow wound therearound ascends slowly up to position 6B (FIG. 3) together with the tow guide 20 by actuation of the air cylinder 26 of the elevator 44 (FIG. 5). Thereafter, a traverse motor 30 for traversing the track 17 (FIG. 5) is driven to rotate the pinion 31 on the rack 47 fixed to the platform 33 whereby the winding roll apparatus reaches position 6C (FIG. 3) where the tow guide 20 is stopped in motion and the tow takes a passageway to 6C. Thereafter, the winding roll 6 descends slowly by actuation of the air cylinder 26 of the elevator to reach position 6D (FIG. 3). Then the tow is guided by a guide bar 18 to exactly pass through the top surface of the pinch roll 8 having a larger width than the other pinch roll 9, and is wound around the winding roll 6 having moved to position 6D and the tow route takes a passageway of 6D.

At the same time when the winding roll 6 reaches position 6D, the pinch rolls 8, 9 start to rotate in response to a signal from a controller. At the same time, the winding roll 6 is stopped and the tow passes between the pinch rolls 8 and 9 and is fed into the case.

Thereafter, the tow left between the case 60 and the winding roll 6 and the yarn wastes wound around the winding roll 6 are cut by an automatic cutter or by a scissors and removed. Thereafter a signal to return to the normal position (6A) of the winding roll 6 is sent to a controller, whereby the winding roll 6 is pulled inward by actuation of the pusher 22 (FIG. 5), and the winding roll apparatus 25 moves from the position 6D to the positions 6C, 6B and 6A in this order by the operation of the elevator 44 and the truck 17 for ascending or descending, and also by traversing. Thus, the winding roll apparatus 25 returns to the normal position 6A where the winding roll 6 is stopped. Further, the yarn wastes wrapped around the pinch rolls 8A, 9A on the back side of the housing 13 (FIG. 4) are cut by a secondary cutter and removed. Thus, the total operation of the tow resetting is completed.

In the present invention, it goes without saying that operations of ascending, descending, rotation, starting and stopping of the winding roll, traverse of the truck, and like operations or various operations of the pinch rolls apparatus may be carried out manually in part.

In the present invention, the foregoing description has been made referring to the embodiment using a winding roll 6 having two different roll surface sections, but the tow may be wound around a winding roll having an entirely smooth surface or may be wound up around a winding roll without any tow guide.

According to the embodiments of the present invention, when a tow has been tangled around the pinch rolls, it is possible to reset a tow automatically with an exchange of the pinch rolls for another to make continuous watching or monitoring of a tow unnecessary and to lessen the labors of operators. The time required for resetting a tow to the pinch rolls is saved by the automatic operation to reduce labor for removing yarn wastes. For example, while according to a conventional apparatus, about 15 to 25 minutes or longer has been required for removing yarn wastes wrapped around the pinch rolls and the like, according to the apparatus of the present invention, about 50 seconds to 2 minutes are sufficient, so that production efficiency has increased notably.

Further, according to the embodiment of the present invention, by arranging the tow guide 20 with the winding roll, it is possible to wind up a tow as far as the utmost of the effective width of the winding roll. Thus, even in the case of a very fine tow, the time required for resetting a tow is sufficient so that resetting can be carried out safely.

Further, according to the embodiment of the present invention, by using a winding roll having a smooth surface section and a rough surface section, the former being for passing a tow to the pinch rolls and the latter being for winding up a tow therearound, it is possible to completely carry out winding up of the two around the winding roll without any failure.

According to the present invention, by shortening the rest time of the apparatus, it has been possible to reduce the quantity of yarn wastes from several hundred Kg in the case of a conventional apparatus down to several tens of Kg, for example.

Further, when a tow has been tangled around pinch rolls, at least several operators have been required for resetting them, whereas according to the apparatus of the present invention, only one operator may reset the apparatus.

The apparatus of the present invention can be broadly applied to a handling process for not only a tow of synthetic fibers prepared by melt-spinning, but also to a crimped tow having a fineness of several thousand to several hundred thousand deniers, and the like material such as multifilament, cotton yarns, tape yarn, fiber rod, etc.

What we claim is:

1. A tow feeding apparatus having pinch rolls for feeding a tow into a case, which comprises a plurality of guide rolls for guiding a tow along a tow route to a plurality of pinch rolls, said guide rolls and said pinch rolls being located along said tow route;

a winding roll apparatus provided between said guide rolls and pinch rolls for winding up the tow when said tow becomes entangled in said pinch rolls, said winding roll apparatus comprising a winding roll for winding up the tow and a driving motor for driving said winding roll;

a first pinch roll apparatus for feeding said tow from the guide rolls through said winding roll apparatus into a case, said first pinch roll apparatus comprising said plurality of pinch rolls, and said first pinch roll apparatus being movably located at a pinch roll station;

a transporting means for transporting said winding roll apparatus from a first position with respect to said pinch roll station to a second position with respect to the pinch roll station when said tow becomes entangled in said pinch rolls;

a cutter provided along the tow route between at least one of said guide rolls and at least one or said pinch rolls for cutting the tow;

an exchanger for exchanging said first pinch roll apparatus for a second pinch roll apparatus;

a detector for detecting entanglement of said tow around the pinch rolls; and control means for receiving a signal from said detector, actuating said cutter, actuating said driving motor for driving the winding roll, stopping the first pinch roll apparatus, driving said exchanger for exchanging the first pinch roll apparatus for the second pinch roll apparatus, actuating said transporting means for moving the winding roll apparatus form said first position to said second position relative to the pinch roll station, starting the second pinch roll apparatus at the same time as stopping the winding roll apparatus, and returning the winding roll to said first position.

2. A tow feeding apparatus according to claim 1, wherein said transporting means comprises a platform laterally installed over said pinch roll station;

a truck movably supported on said platform by means of wheels;

an elevator supported by said truck and operably associated with said winding roll apparatus, for moving said winding roll apparatus upward or downward; and driving means for driving said truck and said elevator so that said winding roll apparatus is transported between said first position and said second position.

3. A tow feeding apparatus according to claim 1, wherein said winding roll apparatus has a pusher for moving said winding roll in the axial direction thereof by a predetermined length, and a guide means provided along the tow route for traversing the tow within the breadth of the winding roll during operation thereof, and wherein said winding roll has a smooth surface section and a rough surface section in the axial direction of the winding roll so that the tow is wound around said rough surface section of the roll when the winding roll is pushed forward by a predetermined length by said pusher, and so that the tow is wound around the smooth section of the winding roll toward the pinch roll station when the winding roll is returned to the first position.

4. A tow feeding apparatus according to claim 2, wherein said elevator comprises an air cylinder which is connected to the winding roll apparatus so as to move the winding roll apparatus upward and downward, a guide fixed with respect to said truck, and a guide rail fixed vertically to the winding roll apparatus for guiding said guide therealong when said air cylinder moves the winding roll apparatus.

5. A tow feeding apparatus according to claim 2, wherein said driving means for driving said truck comprises a rack and pinion connected to said platform and truck, respectively, and a driving motor for driving the pinion.

6. A tow feeding apparatus according to claim 1, wherein each said pinch roll apparatus comprises a plurality of pinch rolls for feeding the tow into the case when the respective pinch roll apparatus is at the pinch roll station, a driving motor for driving the pinch rolls of the pinch roll apparatus that is present at the pinch roll station, a first roll of each said pinch roll apparatus having a broader surface than that of a second roll of each said pinch roll apparatus, and a guide bar for preventing the tow from feeding into the pinch rolls when the tow is wound around the winding roll at the time of transport from the first position to the second position.

7. A tow feeding apparatus according to claim 1, wherein said exchanger has a turntable on which said first and second pinch roll apparatuses are provided in an exchangeable manner.

8. A tow feeding apparatus according to claim 1, wherein said detector for detecting entanglement of the tow is a means for detecting an abnormal current value of the driving motor of pinch rolls.

9. A tow feeding apparatus according to claim 1, wherein said cutter of the tow is fixed on the tow route before the pinch roll station.

10. A tow feeding apparatus according to claim 1, wherein an air-jet means is provided at the cutter for winding the tow around the winding roll.

11. A tow feeding apparatus according to claim 1, wherein the winding roll has a guide for traversing the tow within a breadth of the winding roll during operation of the winding roll.

12. A tow feeding apparatus according to claim 1, wherein a secondary cutter is provided for cutting the tow left between the pinch rolls and the winding roll at said second position.

13. A tow feeding apparatus according to claim 1, wherein said control means comprises an actuator of the cutter for cutting the tow responsive to a signal from said detector;

an actuator of said winding roll apparatus, actuated by a signal from the detector;

a stopping means for stopping said winding roll apparatus after cutting of the tow;

a controller of said exchanger of the pinch rolls apparatus, which functions so that the first pinch roll apparatus is exchanged for the second pinch roll apparatus at the same time as the winding roll apparatus is stopped;

a controller of said elevator and said driving means of said truck, which is actuated after the cutting of the tow and functions so that said winding apparatus moves upward from the backward side of the pinch roll station, then moves laterally over said pinch roll station along the tow route, and further moves downward to the forward side of the pinch roll station;

a starting means for starting the second pinch roll apparatus when the winding roll apparatus reaches said second position, and a stopping means for stopping the winding roll apparatus at the same time as starting of the second pinch roll apparatus; and a controller for returning the winding roll to the first position after removing of waste from the winding roll.

* * * * *